US006431021B1

(12) United States Patent
Djordjevic et al.

(10) Patent No.: US 6,431,021 B1
(45) Date of Patent: Aug. 13, 2002

(54) ADJUSTABLE PEDAL

(75) Inventors: Nebojsa Djordjevic; Kristopher B. Rogers, both of Toronto (CA)

(73) Assignee: Atoma International Corp., Newmarket (CA)

( * ) Notice: Subject to any disclaimer, the term of this patent is extended or adjusted under 35 U.S.C. 154(b) by 0 days.

(21) Appl. No.: 09/603,137

(22) Filed: Jun. 23, 2000

(51) Int. Cl.[7] ..... G05G 1/14
(52) U.S. Cl. ..... 74/512; 74/560
(58) Field of Search ..... 74/512, 513, 560

(56) References Cited

U.S. PATENT DOCUMENTS 3,282,125 A * 11/1966 Dully ..... 74/512
4,497,399 A 2/1985 Kopich
5,676,220 A * 10/1997 Dapsi et al. ..... 180/334
5,697,260 A 12/1997 Rixon et al.
5,735,764 A * 4/1998 Shaffer et al. ..... 475/88
5,823,064 A * 10/1998 Cicotte ..... 74/512
5,885,143 A 3/1999 Ichikawa et al.
5,901,614 A * 5/1999 Ewing ..... 74/512
5,927,154 A * 7/1999 Elton et al. ..... 74/512

FOREIGN PATENT DOCUMENTS

EP 0918273 A1 * 5/1999 ..... 74/512

* cited by examiner

*Primary Examiner*—Thomas B. Will
*Assistant Examiner*—Meredith C. Petravick
(74) *Attorney, Agent, or Firm*—Clark Hill PLC

(57) ABSTRACT

A pedal assembly has a mounting bracket for mounting the pedal assembly on a vehicle. A link is pivotally connected to the mounting bracket for movement about a first pivot axis. The link is operably connectable to a control system of the vehicle. A pivot connection mechanism pivotally connects an arm of the pedal to the link for movement about a second pivot axis which is spaced from the first pivot axis. The pivot connection mechanism has a drive operably connected to the arm for effecting articulating movement of the pedal relative to the mounting bracket about the second pivot axis. The pivot connection mechanism has a taumel gear connection between the arm and the link providing continuous engagement therebetween. The pivot connection mechanism is enclosed to protect against dirt and debris.

4 Claims, 1 Drawing Sheet

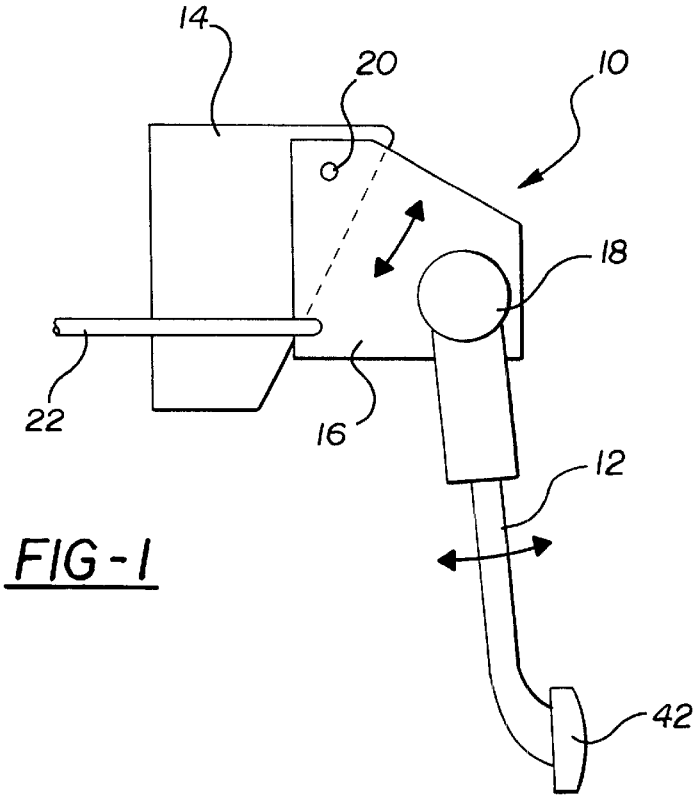
FIG-1
FIG-2
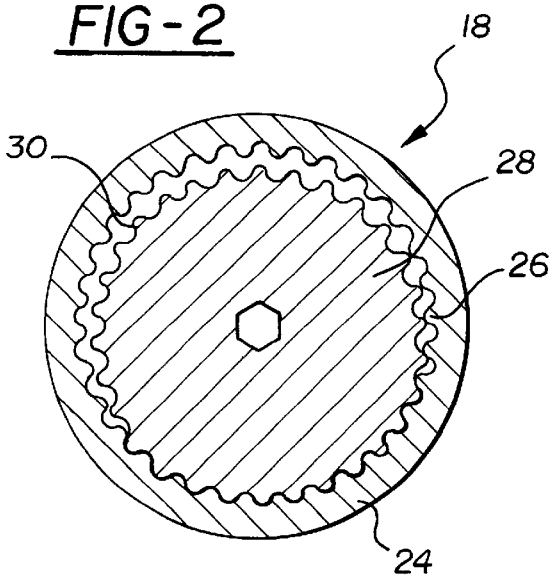
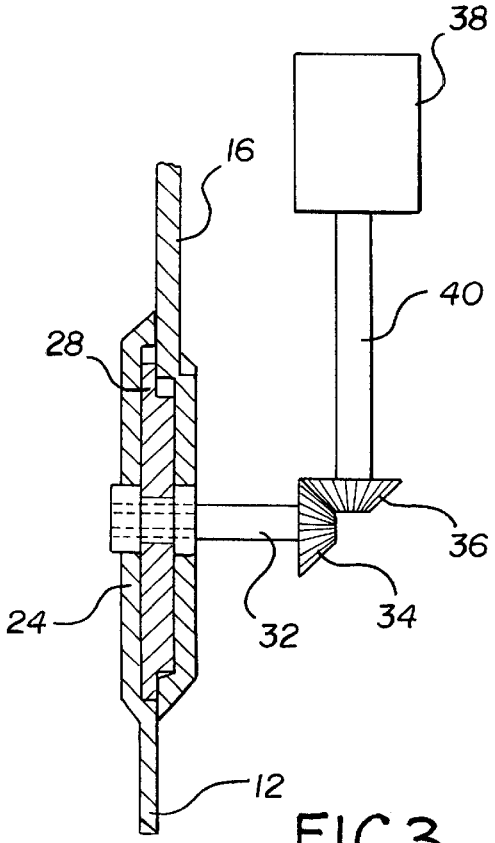
FIG-3

ADJUSTABLE PEDAL

FIELD OF THE INVENTION

This invention relates to an adjustable pedal assembly. In particular, this invention relates to a brake pedal which articulates to move the pedal forward and aft.

BACKGROUND OF INVENTION

Automobiles are now equipped with inflatable restraint systems or air bag mounted in the steering wheel.

Drivers who have short legs must move the seat forward in order to properly depress the brake pedal. This requirement will position the driver's torso very close to the steering and the air bag.

Air bags require a minimum distance between the driver and the steering wheel in order to be effective. If the driver is too close to the steering wheel when the air bag inflates, the driver could be injured from the inflation or the driver may prevent the air bag from properly inflating.

Several adjustable control pedal assemblies have been proposed, including U.S. Pat. Nos. 5,697,260; 5,855,143; and 4,497,399. Each of these assemblies use a driving worm gear to rotate the pedal. If the driving worm gear directly engages the pedal, then the gear ratio required makes the gears relatively large and heavy. If the driving worm gear does not directly drive the pedal, then complex linkages are utilized.

It is desirable to provide a simple mechanism which will rotate a pedal to allow adjustment thereof.

SUMMARY OF THE INVENTION

The disadvantages of the prior art may be overcome by providing an adjustable pedal which articulates to move the pedal fore and aft in order for all drivers to properly depress the pedal.

It is desirable to provide a pedal assembly which has a mounting bracket for mounting the pedal assembly on a vehicle. A link is pivotally connected to the mounting bracket for movement about a first pivot axis. The link is operably connectable to a braking system or control system of the vehicle. A pivot connection mechanism pivotally connects an arm of the pedal to the link for movement about a second pivot axis which is spaced from the first pivot axis. The pivot connection mechanism has a drive operably connected to the arm for effecting articulating movement of the brake pedal relative to the mounting bracket about the second pivot axis. The pivot connection mechanism has a taumel gear connection between the arm and the link providing continuous engagement therebetween. The pivot connection mechanism is enclosed to protect against dirt and debris. Once articulated, the pivot connection mechanism locks the arm relative to the mounting bracket for pivotal movement about the first pivot axis.

DESCRIPTION OF THE DRAWINGS

In drawings which illustrate an embodiment of the invention,

FIG. 1 is a side elevational view of an articulating brake pedal assembly of the present invention;

FIG. 2 is a sectional view of a pivot connection mechanism of the brake pedal assembly of FIG. 1; and FIG. 3 is a sectional view of the pivot connection mechanism of FIG. 2.

DESCRIPTION OF THE INVENTION

Referring to FIG. 1, there is illustrated an articulating brake pedal assembly 10 of the present invention. The brake pedal assembly generally comprises an arm 12, a mounting bracket 14 and a link 16.

Arm 12 is conventional in construction. Arm 12 is elongate and pivotally mounted to the link 16 by pivot connection mechanism 18.

Bracket 14 is preferably a U-shape stamped and formed to present side flanges between which the link 16 extends and pivotally mounts about a first pivot pin 20. Pivot pin 20 defines a first axis of rotation. A shaft 22 is pivotally connected to the link 16. Shaft 22 is operably connected to the master cylinder of the vehicle's brake actuation system.

Referring to FIGS. 2 and 3, the pivot connection mechanism 18 is illustrated in greater detail. The pivot connection mechanism 18 generally comprises a driven plate 24 having a series of internal teeth 26, a driving gear 28 having a series of external teeth 30. Teeth 26 are complementary to teeth 30, except that the number of external teeth 30 is less than the number of internal teeth 26. The outside diameter of driving gear 28 is less than the inside diameter of driven plate 24. The center of rotation of driving gear 28 is offset from the center of rotation of the driven plate 24. This type of gear is commonly known as a taumel or planetary gear.

Link 16 is embossed in the region of driving gear 28. Driving gear 28 is nestingly received in the concave side or recess of embossment 29. Similarly, driven plate 24 is embossed with the internal teeth 26 formed on the circumferential surface of the concave side or recess of the embossment 25. Driven plate 24 is juxtaposed in a face to face relation with link 16 to enclose the pivot connection mechanism 18. The enclosure protects the taumel gear from dirt and debris.

Driving gear 28 is mounted on a shaft 32. Shaft 32 defines a second axis of rotation spaced from the first axis of rotation. The driving gear 28 has a spline connection for driving rotation with shaft 32. As is apparent to those skilled in the art other forms of driving connections may also be used. Shaft 32 has a gear 34 which is in driving engagement with gear 36. Gear 36 is driven by drive motor 38 via drive cable 40. Drive motor 38 is electrically connected to a remote switch for operation by the driver of the vehicle. Drive cable 40 is preferably a flexible cable allowing the motor to be mounted on any suitable surface, preferably on mounting bracket 14. Drive motor 38 will rotate gear 28 which will responsively rotate plate 24 and arm 12.

The adjustable brake assembly 10 of the present invention is installed in the vehicle in a conventional manner. Shaft 22 is preferably part of the master cylinder and pivotally connected to the link 16. Energizing of drive motor 38 in a first polarity will rotate driving gear 28 in a first sense causing rotation of the arm 12 about a second pivot, namely, the axis of the shaft 32. Energizing of the drive motor 38 in the opposite polarity will rotate driving gear 28 in the opposite sense. The brake pedal 42 will move fore and aft in response to actuation of the drive motor 38 rotating relative to the link 16 about the second pivot. In the de-energized state, the drive motor 38 will lock the driving gear 28 and thereby fix the arm 12 relative to the link 16. The driver can depress the pedal 42 which will pivot link 16 about the first pivot 20 to actuate the brakes through shaft 22.

The pivot connection mechanism 18 of the present invention provides a continuous engagement between the arm 12 and the link 16.

The present invention has been described in terms of a pedal assembly for use as brake pedal. It is however, now readily apparent to those skilled in the art that the present invention may also be used in any pedal application, including an accelerator pedal or a clutch pedal.

The above-described embodiment of the invention is intended to be an example of the present invention and alterations and modifications may be effected thereto, by those of skill in the art, without departing from the scope of the invention.

We claim:

1. A pedal assembly comprising:

a mounting bracket for mounting the pedal assembly on a vehicle, a link pivotally connected to the mounting bracket about a first pivot axis and operably connectable to a braking system of the vehicle, a brake pedal having an arm, and a pivot connection mechanism pivotally connecting the arm to the link about a second pivot axis spaced from the first pivot axis, said pivot connection mechanism having a drive operably connected to the arm for effecting articulating movement of the brake pedal relative to the mounting bracket about said second pivot axis and a taumel gear connection between the arm and the link providing continuous engagement therebetween, said taumel gear connection comprising a first gear having a series of external teeth nested within a second gear having a series of internal teeth, said series of external teeth comprising a number of teeth which is at least one less than a number of teeth comprising said series of internal teeth, and wherein said first gear has a center of rotation coaxially with said second pivot axis and said second gear has an axis of rotation offset from said second pivot axis.

2. A pedal assembly as claimed in claim 1 wherein said arm has a driven plate which cooperates with the link enclosing the taumel gear connection.

3. A pedal assembly as claimed in claim 2 wherein said link has a recess nestingly receiving said first gear.

4. A pedal assembly as claim in claim 3 wherein said drive is mounted on said mounting bracket and a flexible drive cable connects the drive to the first gear.

* * * * *